US006813807B2

(12) United States Patent
Ibbertson et al.

(10) Patent No.: US 6,813,807 B2
(45) Date of Patent: Nov. 9, 2004

(54) VACUUM CLEANER HAVING A SECONDARY DIRT AND DUST COLLECTION INLET

(75) Inventors: Hayley Ibbertson, Hull (GB); Julie Stark, Hull (GB)

(73) Assignee: Reckitt Benckiser (UK) Limited, Berkshire (GB)

( * ) Notice: Subject to any disclaimer, the term of this patent is extended or adjusted under 35 U.S.C. 154(b) by 0 days.

(21) Appl. No.: 10/264,770

(22) Filed: Oct. 4, 2002

(65) Prior Publication Data

US 2003/0070251 A1 Apr. 17, 2003

Related U.S. Application Data

(63) Continuation of application No. PCT/GB01/01481, filed on Apr. 4, 2001.

(30) Foreign Application Priority Data

Apr. 6, 2000 (GB) ..... 0008370

(51) Int. Cl.[7] ..... A47L 9/00

(52) U.S. Cl. ..... 15/327.2; 15/331; 15/351; 15/421

(58) Field of Search ..... 15/327.6, 327.2, 15/327, 7, 351, 421, 331, 416, 328; 134/21

(56) References Cited

U.S. PATENT DOCUMENTS

| | | | | | |
|---|---|---|---|---|---|
| 1,468,467 | A | * | 9/1923 | Farnsworth | 15/421 |
| 1,726,592 | A | * | 9/1929 | Spanel | 15/416 |
| 1,911,409 | A | * | 5/1933 | Tucker | 15/416 |
| 3,238,557 | A | * | 3/1966 | Foster | 15/421 |
| 4,854,006 | A | * | 8/1989 | Nishimura et al. | 15/421 |
| 5,199,996 | A | | 4/1993 | Jonas et al. | |
| 5,497,532 | A | | 3/1996 | Glatz | |
| 5,597,347 | A | | 1/1997 | Bosten et al. | |
| 5,943,732 | A | * | 8/1999 | Bosyj et al. | 15/328 |
| 6,032,328 | A | | 3/2000 | Harmon et al. | |
| 6,039,817 | A | * | 3/2000 | Payne | 15/331 |
| 6,079,077 | A | * | 6/2000 | Kajihara et al. | 15/331 |
| 6,161,251 | A | * | 12/2000 | Lee et al. | 15/421 |

FOREIGN PATENT DOCUMENTS

| | | |
|---|---|---|
| DE | 87 16 760.3 U1 | 5/1988 |
| DE | 298 13 717 U1 | 11/1998 |
| EP | 0 650 688 A1 | 5/1995 |
| EP | 0 650 690 A1 | 5/1995 |
| EP | 0 812 563 A2 | 12/1997 |
| EP | 0 826 332 A2 | 3/1998 |
| GB | 1190219 | 4/1970 |
| GB | 2 090 728 A | 7/1982 |

* cited by examiner

*Primary Examiner*—Theresa T. Snider
(74) *Attorney, Agent, or Firm*—Akin Gump Strauss Hauer & Feld, L.L.P.

(57) ABSTRACT

A vacuum cleaner includes a body having a container which collects dirt and dust. A surface cleaning head defining a primary dirt and dust collection inlet is configured to contact a surface over which the surface cleaning head is moved. A passageway connects the primary inlet to the container. A secondary dirt and dust collection inlet is remote from the primary inlet and spaced from the surface. The cleaner suctions dirt and dust through the primary and secondary inlets into the container. The primary inlet is adapted to draw surface-borne dirt and dust efficiently into the container and the secondary inlet is adapted to draw airborne dirt and dust efficiently into the container. Dampening means are provided to at least one of the primary inlet and the secondary inlet and is controlled by an actuator activated directly or indirectly by an operator of the vacuum cleaner.

10 Claims, 1 Drawing Sheet

VACUUM CLEANER HAVING A SECONDARY DIRT AND DUST COLLECTION INLET

CROSS-REFERENCE TO RELATED APPLICATIONS

This application is a Continuation of International Application No. PCT/GB01/01481, filed Apr. 4, 2001, which was published in the English language on Oct. 18, 2001, under International Publication No. WO 01/76444 A1 and the disclosure of which is incorporated herein by reference.

BACKGROUND OF THE INVENTION

The present invention relates to electric appliances, namely vacuum cleaners.

Vacuum cleaners work by suction. An electric motor in the cleaner drives a fan that pumps air from a chamber within the cleaner to create a vacuum. This vacuum is employed to draw air laden with dust and dirt from a surface into a dust bag or into a collection compartment within the cleaner which retains the dirt and dust. The air is expelled through an outlet in the body of the cleaner.

Typically, there are two types of vacuum cleaners, the cylinder vacuum cleaner and the upright vacuum cleaner. In the cylinder vacuum cleaner, a flexible hose connected to a cleaning attachment is provided and the cleaning attachment is passed over a surface to be cleaned to draw air laden with dirt and dust into the collection compartment or dust bag via the hose. In the upright vacuum cleaner, air is drawn into the collection compartment or dust bag through an inlet in a base or foot unit which comprises wheels to allow the cleaner to be pushed and pulled over the surface to be cleaned. To further improve the cleaning action of the cleaner, a rotating brush is provided across the inlet in the base unit that beats dirt and dust out of the surface to be cleaned. Some upright cleaners are also provided with a flexible hose and cleaning attachment like the cylinder type for the purpose of cleaning surfaces such as floors and upholstery, and means for switching suction between this and the base unit of the cleaner.

Conventional vacuum cleaners of both types are effective in drawing in dirt and dust from the surfaces on which the cleaning attachment or base unit is used. However, they do not draw in airborne particles of dirt and dust. Indeed, the very act of vacuuming can cause large quantities of dirt and dust to become airborne, thereby avoiding the cleaning action of the vacuum cleaner. In this regard, air expelled from the vacuum cleaner blows dirt and dust into the air, movement of the cleaning attachment or base causes dirt and dust to become airborne and even the movement of the operator can raise dirt and dust into the air. The presence of these airborne particles of dirt and dust can be a problem for those people who have dust allergies.

BRIEF SUMMARY OF THE INVENTION

It is an object of the present invention to provide a vacuum cleaner which draws airborne particles of dirt and dust into the cleaner.

According to the present invention there is provided a vacuum cleaner comprising: a body which houses a container in which is collected dirt and dust. A surface cleaning head defines a primary dirt and dust collection inlet able to contact, in use, a surface over which the surface cleaning head is moved. A passageway connects the primary inlet to the container. A secondary dirt and dust collection inlet is remote from the primary inlet and spaced, in use, from the surface. Suction means draw dirt and dust through the primary and secondary inlets into the cleaner. The primary inlet is adapted to draw surface-borne dirt and dust efficiently into the cleaner and the secondary inlet is adapted to draw airborne dirt and dust efficiently into the cleaner.

Airborne particles of dirt and dust from around the cleaner may be sucked into the cleaner by the secondary inlet(s). The advantage of this is that dirt and dust are removed from the room environment and not just from the surface.

There may be only one secondary inlet, in which case it is preferably in the form of a slot. Preferably, however, there is an array of secondary inlets.

The relative cross sections of the first and second inlet can be used to balance the performance of each inlet. Preferably, the cross section of the second inlet is less than two hundred percent (200%) of the cross section of the first inlet, ideally less than one hundred percent (100%). Preferably, the cross section of the second inlet is greater than five percent (5%) of the first inlet, preferably greater than ten percent (10%).

In a preferred embodiment adjustable dampening means may be provided to the first inlet, the second inlet or both first and second inlets so as to adjust the performance of each inlet. Operator adjustments to performance can then be made to adjust the vacuum cleaner to differing cleaning environments, for example, carpet type, room size, levels of dust etc. In a further embodiment, the dampening means may be controlled by an actuator, which may be activated directly or indirectly by the operator to pre-set positions. Electronic control means may be used within the vacuum to control the actuator(s). Sensors may be present in the vacuum cleaner to feed information into the electronic control means which may automatically adjust the dampening means via the actuator(s) during operation in response to the sensor information. Sensors may detect air flow, pressure or levels of dirt.

The dampening means may be any suitable feature known to open or close air inlets, for example, a slideably mounted inlet shutter, air valve, constricting/dilating passageway or a switch to the suction means or any combination thereof.

The electronic control means includes any conventional solid state system or circuit board able to process information input from any optionally present sensor or from the operator and effect a change directly to the dampening means or indirectly to the dampening means via the actuator (s).

In an alternative embodiment, the dampening means are provided to the first and second inlet and are independently able to fully open and fully close, or any position in between, each inlet. Such an orientation of the device allows the vacuum cleaner to be switched between solely taking in air from the primary inlet or the secondary inlet or in any proportion in between.

The secondary inlet(s) may be connected into the passageway connecting the surface cleaning head to the dust and dirt collection compartment in which case both the surface cleaning head and the secondary inlet(s) may share a common suction means. Alternatively, a separate passageway, or passageways, may be provided to connect the secondary inlet(s) to the dust and dirt collection compartment. In this latter case, it may be convenient to provide separate suction means for each passageway.

Suction means will invariably involve an electric motor and/or a fan. These components are conventional in the field to draw the air through the cleaner. The suction means may draw the air through both inlets by way of a single motor drawing air through both inlets or two motors one for each inlet. A single motor could simultaneously draw air through both inlets by driving a fan in each inlet.

In a preferred orientation of the single motor in which the second inlet is connected to the passageway of the first inlet, the cross-sectional area of the secondary inlet relative to the cross-section of the primary inlet will primarily determine the relative air flows between the two inlets.

Dust filtering means, such as an electrostatic filter, may be provided between the secondary inlet(s) and the compartment. This may be appropriate when the air drawn into the secondary inlet(s) ("secondary air") is conveyed over the suction means or part of it (that is, over a fan and/or motor). This may be done to effect cooling. Preferably, however, secondary air is not thus conveyed. Preferably, also, no such dust filtering means between the secondary inlet(s) and the compartment is provided.

With upright vacuum cleaners typically having a wheeled base unit which contains the primary inlet, and articulated to an upright main body which contains the dirt and dust container, there is preferably a plurality of secondary inlets provided in an upper surface of the base unit or in the main body thereof, or in both. With cylinder vacuum cleaners, typically having a single, generally drum shaped, a wheeled body and carrying a cleaning head comprising the primary inlet on a flexible tube, there is preferably a plurality of secondary inlets provided in the body thereof, preferably in the upper region thereof. Alternatively or additionally one or more tubes may extend over the outer casing of the vacuum cleaner, whether of upright or cylinder type, and include a plurality of secondary inlets therein at intervals along its length through which airborne particles of dirt and dust can be drawn. In one such embodiment of the present invention, such a tube extends in a helix around the main body or on the upper surface of the vacuum cleaner.

Preferably the secondary inlets of an array are reasonably well spaced from each other.

Preferably, the secondary inlets of an array are not unidirectional. Unidirectional, in this situation, means all facing in the same direction.

Preferably, at least one secondary inlet of an array faces generally forwards.

Preferably, at least one secondary inlet of an array faces generally rearwards.

Preferably, at least one secondary inlet of an array faces generally sideways.

Preferably, at least one secondary inlet of an array faces generally sideways in one direction and at least one secondary inlet of an array faces generally sideways in the opposite direction.

If wished, at least one secondary inlet of an array faces generally upwards.

Suitably there are at least three (3) secondary inlets in an array, preferably at least five (5), more preferably at least eight (8), and most preferably at least ten (10).

Alternatively or additionally, a secondary inlet may be in the form of a single slot that is not unidirectional. Unidirectional, in this situation, refers to a straight slot provided in a planar face.

Preferably, a secondary inlet in the form of a single slot has a portion which faces generally forwards.

Preferably, a secondary inlet in the form of a single slot has a portion which faces generally rearwards.

Preferably, a secondary inlet in the form of a single slot has a portion which faces generally sideways.

Preferably, a secondary inlet in the form of a slot has a portion which faces generally sideways in one direction and a portion which faces generally sideways in the opposite direction.

A secondary inlet in the form of a slot may extend substantially all the way around the cleaner, such that it can draw in airborne dirt and dust from the front, rear and both sideways directions. Thus, it could be an endless slot or a generally helical slot.

If desired, a secondary inlet in the form of a single slot has a portion which faces generally upwards.

The words "forwards", "rearwards", "sideways" and "upwards" are used herein with reference to the vacuum cleaner in its normal configuration and orientation in use, with the cleaning head at the front but are not meant to be limiting.

In accordance with a second aspect of the present invention there is provided a method of cleaning using a vacuum cleaner of the invention as defined herein, whereby dust and dirt are drawn in from a surface through the primary inlet and from the air by the secondary inlet.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
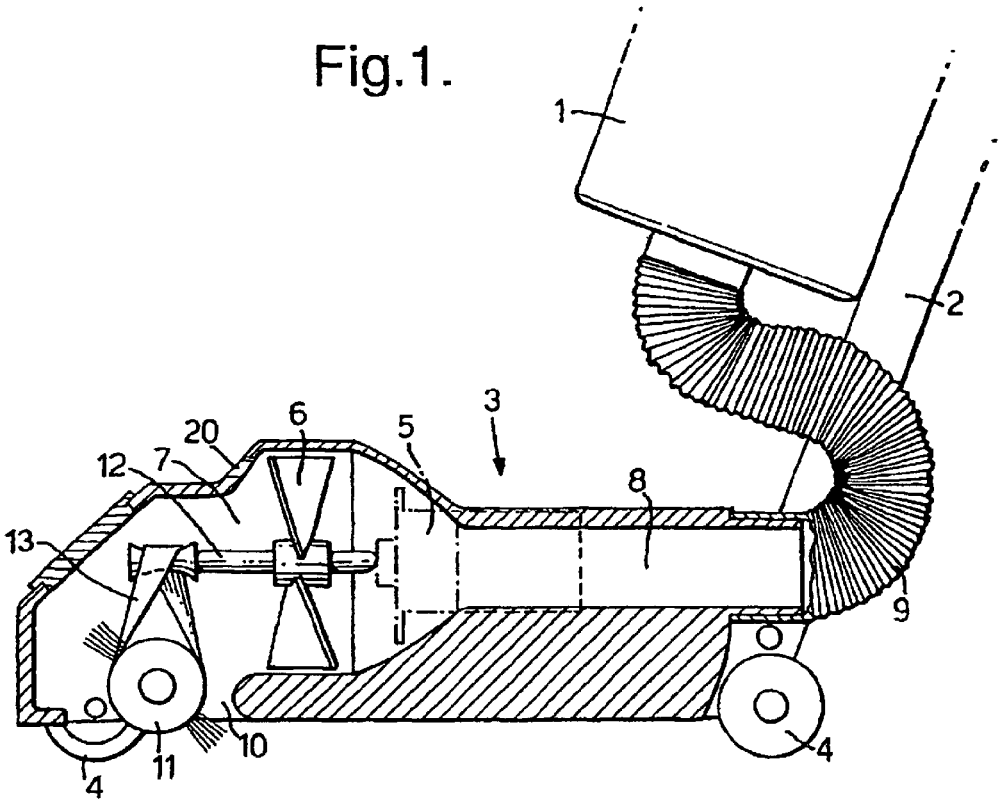
FIG. 1 shows a partial sectional view of an upright vacuum cleaner according to a first preferred embodiment of the present invention.

Referring to FIG. 1 of the drawings the upright vacuum cleaner comprises a main body 1 (only partially shown), the interior of which defines a compartment for the collection of dirt and dust or for housing a dust bag. The body 1 is mounted on an elongate shaft 2, the upper end of which defines a handle (not shown) and the lower end of which is pivotally connected to a base unit 3. The base unit 3 is supported at the front and rear, on wheels or rollers 4 to facilitate movement of the cleaner over the floor.

The base unit 3 includes an electric motor 5 that drives a fan 6 positioned within a chamber 7. To the rear of the chamber 7 there is provided a conveying passageway 8, which is connected via a short length of flexible hose 9 to the compartment in the main body 1. To the front of the chamber 7 there is provided in the floor of the base unit 3 an elongate slot 10. The elongate slot 10 extends from one side to the other of the base unit 3. A roller brush 11 is positioned in the slot 10 and is supported at each end in the sidewall of the base unit 3. The roller brush 11 is rotatably driven by the electric motor 5 acting through an extension to the drive shaft 12 which supports the fan 6 and a drive belt 13.

As was described hereinabove, the upright vacuum cleaner is conventional. Dirt and dust are beaten out of the surface on which the cleaner is supported by the action of the rotating roller brush 11. The dirt and dust is then drawn into the chamber 7 as a result of the vacuum created by the fan 6. The increased air pressure behind the fan 6 pushes air laden with dirt and dust along the conveying passageway 8, through the flexible hose 9, and into the compartment in the main body 1.

The base unit 3 is also provided with an array of secondary air inlets 20 in the upper face thereof. The inlets 20 are spaced from each other in a circular array, of which two can be seen FIG. 1 (one facing generally forwards and the other facing generally rearwards, and with others, not shown, facing in other directions around the circle). A further secondary inlet is at the center of the circle, (not shown) facing generally upwards. It will be appreciated that air from around the cleaner is drawn in through the secondary inlets 20 carrying with it airborne particles of dirt and dust. This air joins with the main column of air drawn in through the passageway 8 and the hose 9 and is drawn into the compartment in the main body 1.

As is shown in FIG. 1, the secondary air inlets 20 in the upper face of the base unit 3 lead directly into the air intake side of the chamber 7 in which the fan 6 is situated. However, it is envisaged that the secondary air inlets 20 may also be connected into the air outlet side of the fan 6 at any point prior to the collection compartment or dust bag. In this regard, where the velocity of the column of air passing between the fan 6 and the collection compartment or dust bag is sufficiently high it will entrain air from a spur pathway. This spur pathway is connected to the secondary air inlets 20 to allow airborne particles of dirt and dust to be drawn in.

Figure 2:
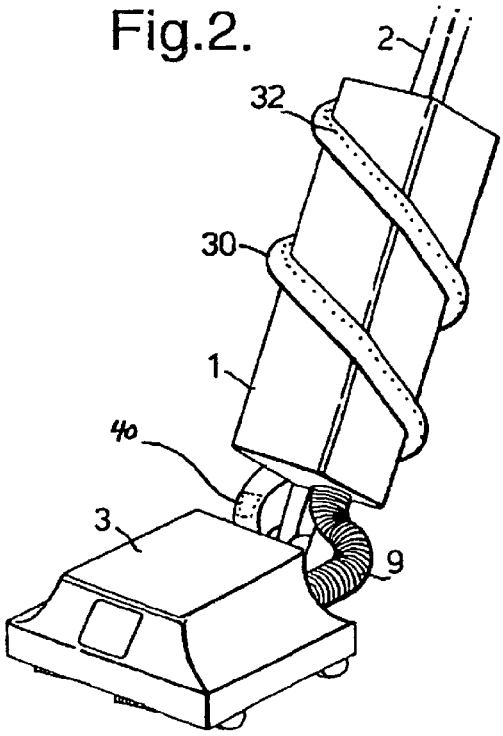
FIG. 2 shows an upright vacuum cleaner according to a second preferred embodiment of the present invention.

Referring now to FIG. 2 there is shown another upright vacuum cleaner embodying the present invention. For the purposes of explanation this can be considered to be identical in all conventional respects to the one described hereinbefore with reference to FIG. 1. However, instead of having secondary air inlets 20 in the upper part of the base unit 3, the cleaner is provided with a tube 30 which is wrapped around the main body 1 thereof. The tube 30 may be a separate component from the main body 1, but preferably is formed integrally with the main body 1. The upper end of the tube 30 is closed and the lower end thereof is connected into the base unit 3 to join with the main airway therethrough. Small holes 32, several dozen in total, are provided at intervals along the length of the tube 30. A dampening means controlled by an actuator, schematically shown at 40, activated directly or indirectly by an operator (not shown) of the vacuum cleaner as described above, is preferably located in the tube 30, near where the tube 30 attaches to the base unit 3.

In use, air around the main body 1 of the cleaner is drawn into the tube 30 through the holes 32, carrying with it airborne particles of dirt and dust. From the tube 30 the air passes into the base unit 3 where it joins with the main column of air passing therethrough into the collection compartment within the main body 1.

The present invention has been described with reference to upright vacuum cleaners. However, it is equally applicable to cylinder vacuum cleaners having a wheeled unit containing the container for dirt and dust, and with the cleaning head, having the primary inlet carried on a flexible tube. Thus, in another embodiment, not shown in the drawings, a cylinder vacuum cleaner has instead of a multiplicity of secondary inlets, a horizontal slot extending all the way around its housing adjacent to its upper end to serve as the secondary inlet. The air drawn in through the slot is directed by an internal conduit to the collection compartment.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A vacuum cleaner comprising: a main body having a container which collects dirt and dust; a surface cleaning head defining a primary dirt and dust collection inlet configured to contact a surface over which the surface cleaning head is moved; a passageway connecting the primary dirt and dust collection inlet to the container; a secondary dirt and dust collection inlet remote from the primary dirt and dust collection inlet and spaced from said surface and connected to the container by way of a secondary passageway which is separate from the passageway connecting the primary dirt and dust collection inlet to the container; and suction means in fluid communication with the passageway for drawing dirt and dust through the primary and secondary inlets into the container, the primary dirt and dust collection inlet being adapted to draw surface-borne dirt and dust efficiently into the container and the secondary dirt and dust collection inlet being adapted to draw airborne dirt and dust efficiently into the container, wherein dampening means are provided to at least one of the primary dirt and dust collection inlet and the secondary dirt and dust collection inlet for at least partially opening and closing the respective dirt and dust collection inlet, the dampening means being controlled by an actuator activated directly or indirectly by an operator of the vacuum cleaner.

2. The vacuum cleaner according to claim 1, wherein at least the secondary dirt and dust collection inlet is in the form of a non-unidirectional slot.

3. The vacuum cleaner according to claim 1, wherein the secondary dirt and dust collection inlet includes an array of secondary inlets.

4. The vacuum cleaner of claim 3, wherein the array of secondary inlets are not unidirectional.

5. The vacuum cleaner of claim 4, wherein at least one secondary dirt and dust collection inlet faces generally forwards, at least one secondary dirt and dust collection inlet faces generally rearwards, at least one secondary dirt and dust collection inlet faces generally sideways in a first direction, and at least one secondary dirt and dust collection inlet faces generally sideways in a second direction opposite the first direction.

6. The vacuum cleaner of claim 1, wherein the vacuum cleaner is an upright vacuum cleaner further comprising: a base unit having the surface cleaning head, the secondary dirt and dust collection inlet being provided in at least one of an upper surface of the base unit and the main body.

7. The vacuum cleaner according to claim 1, wherein the vacuum cleaner is a cylinder vacuum cleaner, the secondary dirt and dust collection inlet being provided in an upper region of the main body thereof.

8. A vacuum cleaner comprising: a main body having a container which collects dirt and dust; a surface cleaning head defining a primary dirt and dust collection inlet configured to contact a surface over which the surface cleaning head is moved; a passageway connecting the primary dirt and dust collection inlet to the container; a secondary dirt and dust collection inlet remote from the primary dirt and dust collection inlet and spaced from said surface, the secondary dirt and dust collection inlet being in the form of an elongate tube at least partially attached to the container and having at least one hole through a sidewall or end cap thereof; and suction means in fluid communication with the passageway for drawing dirt and dust through the primary and secondary inlets into the container, the primary dirt and dust collection inlet being adapted to draw surface-borne dirt and dust efficiently into the container and the secondary dirt and dust collection inlet being adapted to draw airborne dirt and dust efficiently into the container.

9. A vacuum cleaner comprising: a main body having a container which collects dirt and dust; a surface cleaning head defining a primary dirt and dust collection inlet configured to contact a surface over which the surface cleaning head is moved; a passageway connecting the primary dirt and dust collection inlet to the container; a secondary dirt and dust collection inlet remote from the primary dirt and dust collection inlet and spaced from said surface, the secondary dirt and dust collection inlet including an array of secondary inlets, wherein the array of secondary inlets are not unidirectional; and suction means in fluid communication with the passageway for drawing dirt and dust through the primary and secondary inlets into the container, the primary dirt and dust collection inlet being adapted to draw surface-borne dirt and dust efficiently into the container and the secondary dirt and dust collection inlet being adapted to draw airborne dirt and dust efficiently into the container, wherein dampening means are provided to at least one of the primary dirt and dust collection inlet and the secondary dirt and dust collection inlet for at least partially opening and closing the respective dirt and dust collection inlet, the dampening means being controlled by an actuator activated directly or indirectly by an operator of the vacuum cleaner, wherein at least one secondary dirt and dust collection inlet faces generally forwards, at least one secondary dirt and dust collection inlet faces generally rearwards, at least one secondary dirt and dust collection inlet faces generally sideways in a first direction, and at least one secondary dirt and dust collection inlet faces generally sideways in a second direction opposite the first direction.

10. A vacuum cleaner comprising: a main body having a container which collects dirt and dust; a surface cleaning head defining a primary dirt and dust collection inlet configured to contact a surface over which the surface cleaning head is moved; a passageway connecting the primary dirt and dust collection inlet to the container; a secondary dirt and dust collection inlet remote from the primary dirt and dust collection inlet and spaced from said surface; and suction means in fluid communication with the passageway for drawing dirt and dust through the primary and secondary inlets into the container, the primary dirt and dust collection inlet being adapted to draw surface-borne dirt and dust efficiently into the container and the secondary dirt and dust collection inlet being adapted to draw airborne dirt and dust efficiently into the container, wherein dampening means are provided to at least one of the primary dirt and dust collection inlet and the secondary dirt and dust collection inlet for at least partially opening and closing the respective dirt and dust collection inlet, the dampening means being controlled by an actuator activated directly or indirectly by an operator of the vacuum cleaner, wherein the vacuum cleaner is a cylinder vacuum cleaner, the secondary dirt and dust collection inlet being provided in an upper region of the main body thereof.

* * * * *